United States Patent [19]

Scheffel et al.

[11] 4,151,801

[45] May 1, 1979

[54] SELF-STEERING RAILWAY TRUCK

[75] Inventors: Herbert Scheffel, Groenkloof; Rowlen E. Von Gericke, Kempton Park, both of South Africa

[73] Assignee: South African Inventions Development Corporation, Pretoria, South Africa

[21] Appl. No.: 702,159

[22] Filed: Jul. 2, 1976

[30] Foreign Application Priority Data

Jul. 8, 1975 [ZA] South Africa ..... 75/4371
Feb. 9, 1976 [ZA] South Africa ..... 76/0738

[51] Int. Cl.[2] ..... B61F 3/08; B61F 5/06; B61F 5/30; B61F 5/38

[52] U.S. Cl. ..... 105/168; 105/182 R; 105/210; 105/224.1; 267/9 A

[58] Field of Search ..... 105/165, 167, 168, 180, 105/182 R, 197 A, 199 CB, 224 R, 224.1, 80, 210; 267/3, 152, 153, 9 A; 308/138; 295/34

[56] References Cited

U.S. PATENT DOCUMENTS

| | | | |
|---|---|---|---|
| 435,918 | 9/1890 | Clark | 105/168 |
| 562,406 | 6/1896 | Meek | 105/210 |
| 1,172,497 | 2/1916 | Steffens | 105/165 |
| 1,293,628 | 2/1919 | Coda | 295/34 |
| 2,052,660 | 9/1936 | Rocard | 105/80 |
| 2,244,502 | 6/1941 | Piron | 105/224.1 X |
| 2,258,663 | 10/1941 | Travilla, Jr. et al. | 105/224.1 |
| 3,099,967 | 8/1963 | Hirst et al. | 105/224.1 |
| 3,528,374 | 9/1970 | Wickens | 105/165 X |
| 3,575,403 | 4/1971 | Hamel et al. | 267/3 X |
| 3,862,606 | 1/1975 | Scales | 105/224 R X |
| 4,003,316 | 1/1977 | Monselle | 105/224.1 |
| 4,067,261 | 1/1978 | Scheffel | 105/182 R X |
| 4,067,262 | 1/1978 | Scheffel | 105/182 R X |

*Primary Examiner*—Albert J. Makay
*Assistant Examiner*—Howard Beltran
*Attorney, Agent, or Firm*—Ladas, Parry, Von Gehr, Goldsmith & Deschamps

[57] ABSTRACT

A railway truck suspension including a load-bearing member, a pair of wheelsets supporting the load-bearing member, each wheelset being self-steering, and means interconnecting the wheelsets such that they yaw in opposite sense, the interconnecting means comprising a pair of arms on each side of the longitudinal axis of the truck in its direction of travel, each arm being secured at one end to an axle-supported bearing on a wheelset to transmit moments to that wheelset and the arms on the same side of the longitudinal axis extending generally towards each other, and means coupling the other ends of the arms together to allow lost motion between these ends while transmitting rotation of either arm to the other arm.

11 Claims, 8 Drawing Figures

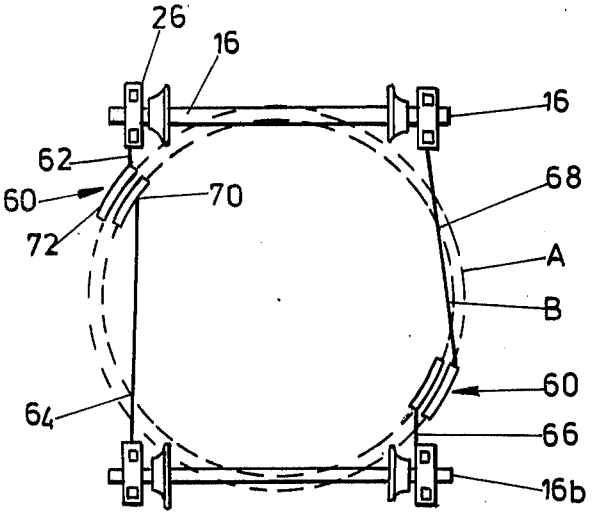
Fig. 3
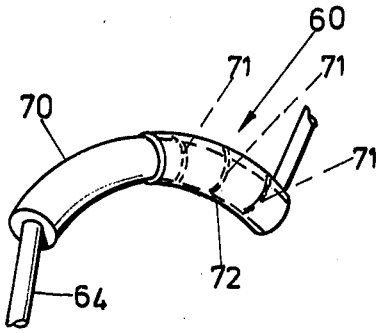
Fig. 4
Fig. 5
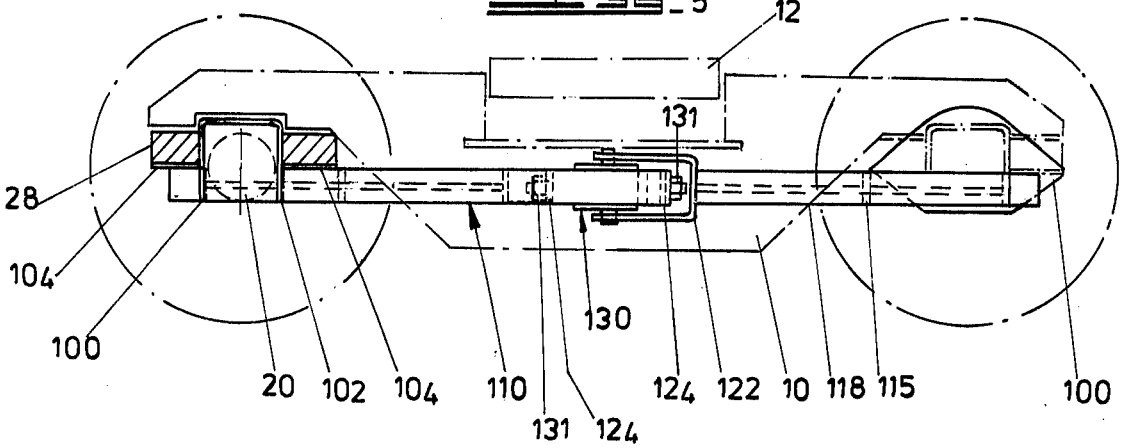
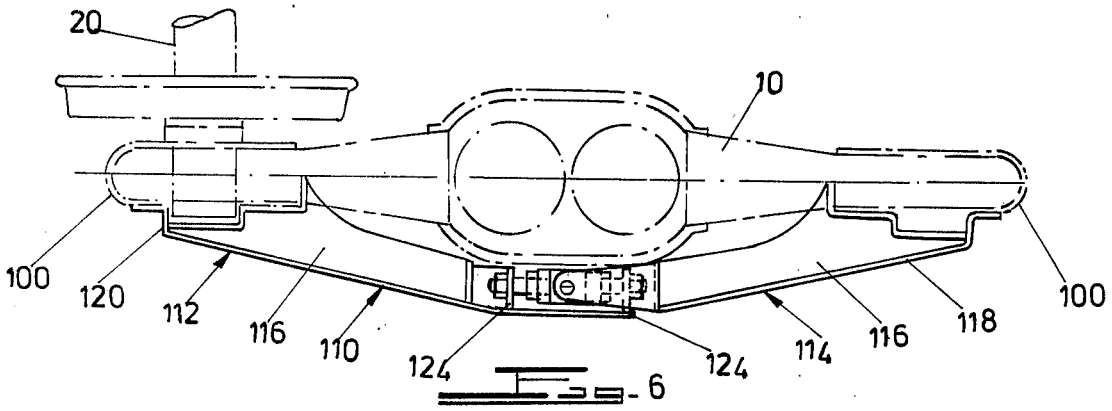
Fig. 6

Fig. 7
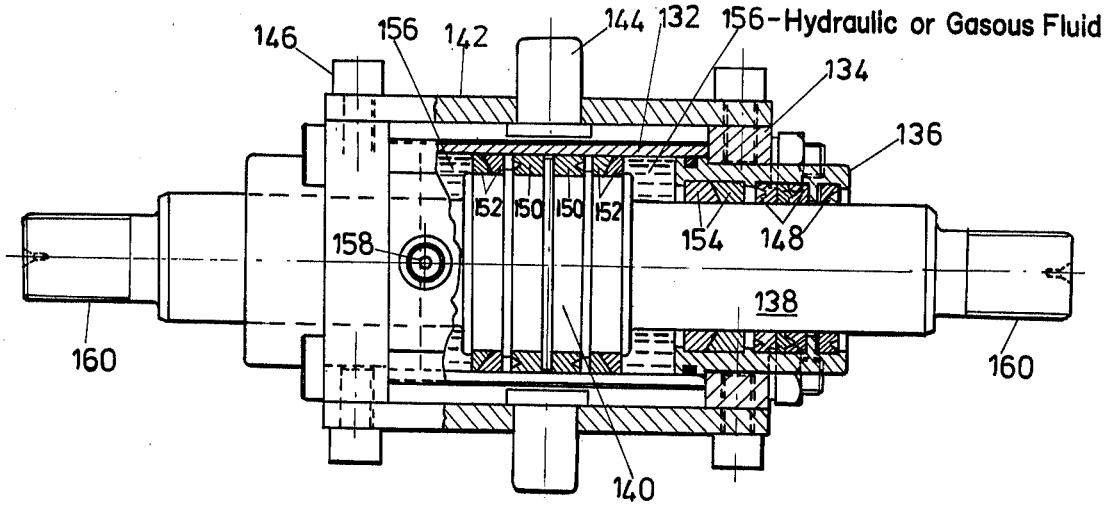
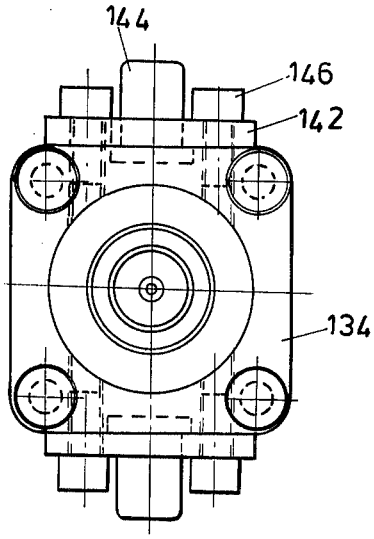
Fig. 8

SELF-STEERING RAILWAY TRUCK

CROSS-REFERENCE TO RELATED APPLICATION

This application is related to Ser. No. 702,304, filed July 2, 1976, U.S. Pat. No. 4,067,261, issued Jan. 10, 1978, which is a continuation-in-part of Ser. No. 415,232, filed Nov. 12, 1973, now abandoned.

Thus invention relates to railway vehicles and in particular to suspension structures for such vehicles. The invention is applicable to railway vehicles in which a body or superstructure is pivotally supported on bogies (trucks) and to railway vehicles in which the vehicle body is directly supported on the wheelsets, e.g. Four-wheeled vehicles.

In this specification the term "railway truck" is defined to mean a basic railway vehicle unit including a load bearing means supported on at least two wheelsets. Thus a railway truck may be a bogie or a four-wheeled vehicle with the term "load-bearing means" being the body in the event of a four-wheeled vehicle and being one of the frame members in the event of a bogie.

There are two basic objectives which must be met for good performance of a railway vehicle. Firstly the vehicle should be able to negotiate successfully the curves of the system on which it is to be used. And secondly the vehicle should be stable with respect to "hunting", i.e. oscillations of the various vehicle masses, such as the wheelsets, bogie and body. Conventional thinking regards the requirements for obtaining hunting stability and good curving ability to be incompatible.

The hunting stability of a railway vehicle is dependent on its suspension design and on the various suspension parameters such as tread conicity, yaw constraints on the wheelsets, damping between the masses of the vehicle, etc. For the hunting stability to be retained in service, it is necessary to ensure that the various suspension parameters remain constant. With conventional suspension designs the hunting stability changes as the treads wear from an original straight taper of about 1/20 or less to a concave or hollow profile with an effective conicity considerably greater than 1/20. Such wear is unavoidable since curving is obtained by the wheel-flanges contacting the rails and by the treads slipping on the rails.

The aforesaid U.S. Pat. No. 4,067,261, which satisfactorily resolve the conventional conflict and provides a railway truck having a good curving ability simultaneously with a high hunting stability. In essence the wheelsets are made to be self-steering and structure is provided to counteract any tendency to hunting caused by making the wheelsets self-steering. Particular structures which are successful are those in which means extending substantially diagonally across the truck is provided to interconnect a pair of wheelsets such that their turning movements are coupled in opposite senses, i.e. 180° out of phase. Such means does not interfere with the natural self-steering ability of the wheelsets but acts to ensure that the wheelsets and load-bearing means supported on them do not oscillate in phase with one another so that stabilising creep forces can be generated in the wheel/rail contact areas. The hunting stability of such a truck does not change in service as the wheels are profiled to the "standard wear profile" which does not vary appreciably with wear which in any event is minimal as there is no slip between the wheels and the rails.

A problem of the disclosed structures is that, because they extend substantially diagonally across the truck, they cannot be conveniently installed in bogies where in general space is very limited. This applies particularly to converting existing bogies, but is also applicable to bogies especially designed to accommodate these structures as there are always numerous other components, such as brakes, brake-beams, etc., which have to be accommodated. This problem is made even more apparent when it is realised, as has been proved by tests, that it is essential that the interconnecting means does not contact any other part of the truck as this negates any benefit which it provides.

It is an object of the invention to provide a railway truck including means for interconnecting the wheelsets to couple their turning movements in opposite senses, which means is simple and easy to install in the truck.

According to the invention the interconnecting means includes a pair of arms on the same side of the longitudinal axis of the truck, the arms extending generally towards each other and each arm being secured at one end to a wheelset to transmit moments to that wheelset, and means coupling the other ends of the arms together to allow lost motion between these ends while transmitting rotation of either of the arms in the general plane containing the arms to the other arm.

The coupling means comprises two elements that are interengaged with and slidable relatively to one another.

Preferably damping means is provided to resist relative motion between the interengaged elements. The damping means may be a liquid or gas damper or may be friction damping.

Preferably the interengaging elements are a piston and cylinder.

In one form of the invention one of the interengaged elements is pivotally connected to one of the arms and the other element is solidly secured to the other arm.

In another form of the invention at least one, though preferably both, of the arms are solidly secured to their respective interengaging elements and the interengaging elements are arcuate with their arcs each aligned on a circular path centered on the longitudinal axis of the truck midway between the wheelsets.

The invention is further discussed with reference to the accompanying drawings, in which, for simplicity, the same or similar parts have the same reference numerals and in which:

FIG. 3 shows a schematic plan view of another embodiment of the interconnecting means for the truck of the invention;

FIG. 4 shows, on an enlarged scale, a perspective view of a part of the interconnecting means of FIG. 3;

FIG. 5 shows a side view of part of a bogie and a preferred embodiment of interconnecting means for coupling the turning movements of a pair of wheelsets in opposite senses, parts of the drawing being broken away and parts being shown in outline.

FIG. 6 a similar plan view of the bogie of FIG. 5.

Figure 1:
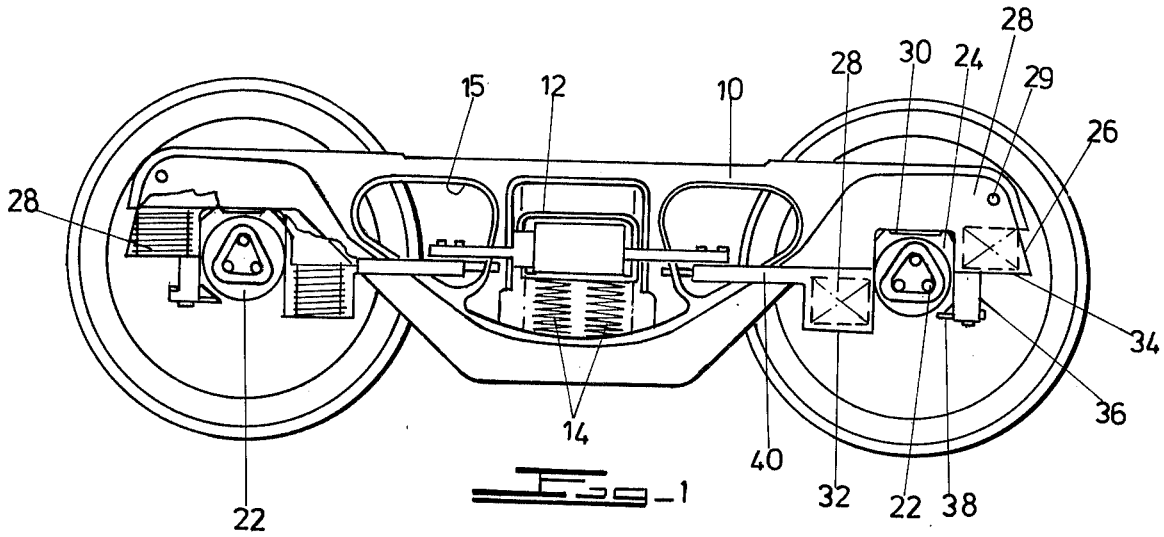
FIG. 1 shows a side view, with parts broken away for clarity, of a railway bogie of the invention fitted with an interconnecting means for coupling the turning movements of a pair of wheelsets in opposite senses.
Figure 2:
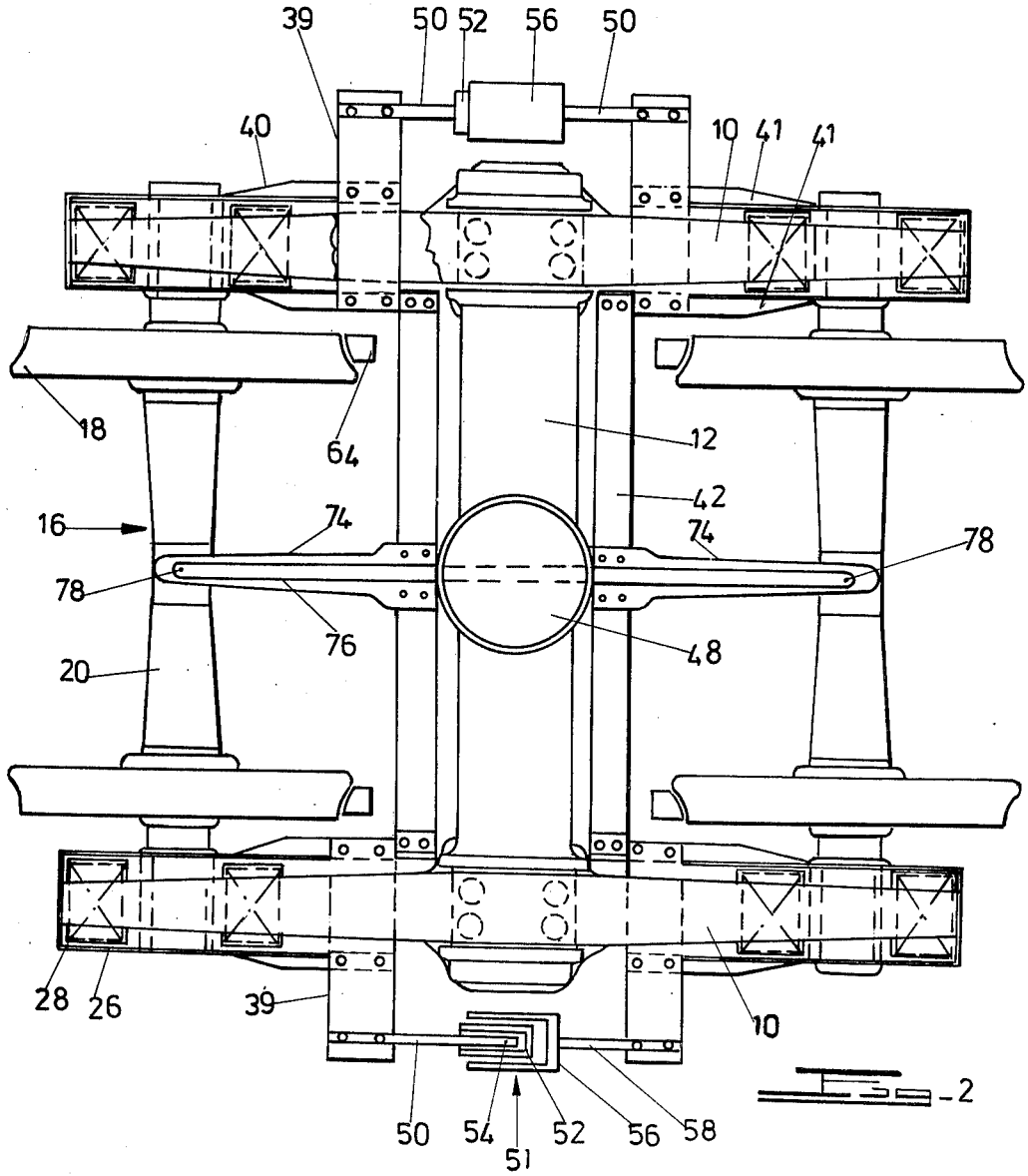
FIG. 2 shows a plan view of the embodiment of FIG. 1, again with parts broken away for clarity.

FIG. 7 shows a side view, partly in section, of a hydraulic damper for the interconnecting means of FIGS. 1 and 2 or for FIGS. 5 and 6; and FIG. 8 shows an end view of the damper of FIG. 7.

FIGS. 1 and 2 of the drawings show a three-piece bogie including two side-frames 10 and a bolster 12 supported by coil springs 14 on the side-frames 10. The bolster is essentially of a hollow, elongate box construction. The side-frames 10 rest on two wheel-sets 16 each comprising a pair of wheels 18 fast or solidly mounted on an axle 20. The axle rotates in bearings 22. Each bearing 22 is connected to a side-frame 10 by a metal pad 24 having an arcuate lower surface which rests on the bearing 22; an adaptor 26 which rests on an upper surface of the pad 24; and two rubber sandwich elements 28 each of which is mounted on the adaptor 26 and which support the side-frame 10. Each rubber sandwich element 28 comprises alternate layers of rubber and metal plate. The bolster has a conventional female wear plate 48 for pivotally supporting a superstructure.

Each adaptor 24 is channel shaped in cross-section and comprises a web 30 which rests on the pad 24 and two spaced apart horizontal supports 32, 34 connected to opposed sides of the web 30. The supports straddle a bearing 22. A depending flange 36 is secured to the support 34 to provide a mounting for a key 38 which prevents the bearing from being separated from the adaptor 26 in the event of excessive relative vertical movement between the adaptor and bearing. A pin 29 passing through registering holes in the adaptor 26 and a relatively larger hole in the side-frame 10 is provided to hold the adaptor to the side-frame in the event of gross relative movement. The supports 32,34 of the adaptor are equally spaced from the horizontal plane passing through the axis of the axle 20, with the support 32 being located below and the support 34 being located above the horizontal plane. This ensures that when forces are applied to the adaptor it does not rotate in a vertical plane. The pad 24 may be welded to the adaptor, alternatively the pad 24 may be a snug fit between the walls of the adaptor 26 which straddle the pad 24. The adaptor is channel shaped to give it strength.

A U-shaped extension member 40 is secured to each adaptor 26 and a beam 42 is connected between the free ends of the extension members on each wheelset to form a moment transmitting sub-frame on that wheelset. Each extension member 40 comprises a plate 39, which passes through a hole 15 formed in the side-frame 10, and struts 41 which secure the plate 39 to the sides of the adaptor 26. The beam 42 is connected between the plates 39 of the extension members 40.

Single-acting brakes 64 are provided for each wheel. Brake-beams and other components for the brakes have not been shown as these may be of any known form.

Each wheel has a profiled tread with a high effective conicity, e.g. the "standard wear profile".

The elastomeric elements 28 impose a yaw constraint, i.e. a moment or couple, on the wheelsets which is sufficiently low to permit each wheelset to attain a radial position in a curve. In other words the yaw constraint or couple preventing yawing of each wheelset is less than the steering forces imposed on the wheelset on curved track. The yaw constraint $K_y$ is determined according to the following relationship:

$$K_y < G_r b^2, \text{ where } G_r \approx W\gamma/2R\delta_0$$

Optimally, though not essentially, $K_y < 2G_r l^2$ $G_r$ = the gravitational suspension stiffness;

W = the maximum load selected for each wheelset;

R = the radius of curvature of the profile of the wheel tread;

l = one half the distance between the wheel/rail contact points on the same axle;

b = one half the distance between the resilient elements 28 on the same axle; and $\gamma$ = effective conicity of profiled wheel tread.

With such yaw constraints in combination with the profile of the treads each wheelset is self-steering, i.e. it will curve without slip between the wheels and the rails and without the flanges of the wheels contacting the rails. In other words, in a curve each wheelset will be radially aligned to the curve and the wheels will perform a purely rolling motion. Thus the tread profile and conicity will not change in service and the hunting stability of the truck will remain constant.

The wheelsets 16 of the bogie are interconnected longitudinally by struts 74 solidly connected to the beams 42 of each wheel-set to project over the centre of gravity of that wheelset. An anchor 76 is pivotally connected to the struts 74 at connection points 78 each of which is over the centre of gravity of a wheelset. The anchor 76 passes through holes conventionally formed in the bolster 12 to accommodate brake rods and the like. The anchor 76 prevents the wheelsets from being forced apart when the single-acting brakes 64 are applied. For passenger vehicles and locomotives a further strut, not shown, may be connected between a connection point 78 and the bolster 12 to locate the wheelsets longitudinally relatively to the truck.

The structure described so far is generally applicable to all of the embodiments described below. Similar structure, e.g. adaptors 26, longitudinal anchors 76, wheel-tread profiles, yaw constraints $K_y$ etc., where applicable are also used on Four-wheeled vehicles.

In FIGS. 1 and 2 means interconnecting the wheelsets is provided to couple their turning movements in opposite senses, the interconnecting means on each side of the truck comprising two stiff arms 50 each solidly fixed to a plate 39 on an adaptor 26 and a coupling means 51, comprising a piston 52 and cylinder 56 forming a pneumatic damper assembly, connected between the arms 50. A gudgeon pin 54 pivotally connects the piston 52 to one of the arms 50, the pin 54 extending substantially vertically and being positioned on the transverse axis of the bogie midway between the wheelsets 16. The cylinder 56 snugly surrounds the piston 52 (rings may also be used) and is solidly connected to the other arm 50. The interconnecting means is duplicated on the otherside of the truck. The piston 52 may be spherical or bell shaped (not shown) so that it can pivot inside the cylinder 56 whereby the pin 54 can be dispensed with. The piston can be of polyurethane or the like.

As a further variant, not shown, the coupling means can comprise two plates or the like guided and prestressed against each other to form a friction damper. One of the plates is pivotally connected to one of the arms 50 and the other plate is solidly connected to the other arm 50. The coupling means 51 of FIGS. 1 and 2 can also serve as friction dampers if suitably constructed.

The above described embodiments operate as follows.

When one of the wheelsets pivots about a vertical axis through its centre of gravity then, through the interconnecting means, the other wheelset is caused also to pivot about a vertical axis through its centre of gravity, but in the opposite sense to the first mentioned wheelset. Since the wheelsets pivot in opposite senses the interconnecting means does not interfere with the radial positioning of the wheelsets in a curve. The interconnecting means performs no steering function as the wheelsets are already self-steering. The interconnecting means is effective in counteracting hunting resulting from the wheel-sets being self-steering and this it does by making the wheelsets oscillate out of phase with each other and the load-bearing members resiliently mounted on them. Thus the elastomeric elements 28 become effective, i.e. they can store and release energy, and hunting stabilizing creep forces are generated in the wheel/rail contact areas.

FIG. 3 shows schematically only parts of a railway truck essential to the following description, the details of the truck may be had from FIGS. 1 and 2. In the drawing a pair of wheelsets 16*a* and 16*b* have their adaptors 26 on the same side of the longitudinal axis of the truck interconnected by unequal length arms 62, 64, 66 and 68 and coupling means 60 connected between the arms 62, 64 and 66, 68 respectively.

The coupling means comprises a pair of arcuate, complementally curved members 70, 72 connected to each other. The members 70, 72 are curved to lie on circles denoted A and B and centred at C symmetrically between the wheelsets. The circles A, B represent an exploded or magnified pin joint with the circles A, B being concentric annuli, the circle A being connected to the wheelset 16*a* and the circle B being connected to the wheel-set 16*b*. As will be appreciated by persons skilled in the art the arcuate members 70, 72 are minor parts of the concentric annuli A, B. In the drawing each of the members 70, 72 is solidly secured to an arm. However, either one of the members may be pivotally connected to its arm with the other member being solidly secured to its arm so that rotation of one of the arms can still be transmitted to the other arm.

This embodiment functions substantially in the same way as the embodiments of FIG. 1 and 2 with the arcuate form of the members 70, 72 accommodating relative rotation of the arms 62 to 68 where previously in the embodiments of FIGS. 1 and 2 this was accomplished by pivotally connecting one of the arms 50 to the cylinder or the piston of the coupling means 51. The coupling means 60 of the FIG. 3 embodiment also provides a longitudinal constraint on the wheelsets so that the anchor 76 may be dispensed with.

In FIG. 4 the coupling means 60 of FIG. 3 is shown in greater detail. The coupling means in this event is a hydraulic or pneumatic damper comprising a piston 70 and a cylinder 72. Sealing rings 71 of any suitable type are provided. The piston and cylinder are conveniently formed from "cold drawn" pipe manufactured to close tolerances. As will be appreciated by persons skilled in the art, suitable valving, restrictions or vents (not shown) are provided to make the piston and cylinder arrangement function as a fluid damper.

The invention is also applicable to those railway trucks in which the bearing 22 and adaptors 26 are mounted on the axles inboard of the wheels as sometimes is the situation on 4′ 8½″ or 5′ 6″ tracks. The invention is also applicable to those trucks, e.g. locomotives, in which other bearings are mounted inboard of the wheels, such as an electric motor mounted on the axle. Furthermore the invention is also applicable to railway trucks in which the load-bearing members are supported on axle mounted bearings positioned inboard of the wheels and further bearings mounted on the axles outside the wheels are interconnected to couple the turning movements of the wheelsets in opposite senses.

FIGS. 5 and 6 show a side frame 10 of a bogie in outline. A bolster 12 is resiliently supported on the side frame. An adaptor 100 is fitted at each end of each axle 20 of each wheelset and the adaptors are coupled by an interconnecting means 110. Each adaptor 100 (as is best seen on the left hand side of FIG. 5) is composed of a U-shaped web 102 which seats over the bearings on the end of the axle 20, and a pair of horizontal flanges 104 extending to diagonally opposite sides of the axle 20. The flanges 104 are positioned on the plane through the axis of the axle 20. The flanges 104 support resilient elements 28 which in turn support the side frame 10. On the right hand side of FIG. 5 can be seen a plate 108 which reinforces the adaptor 100.

The interconnecting means 110 comprises a pair of arms 112 and 114 each of which is composed of a horizontal wall 116 and vertical wall 118 which reinforces the horizontal wall 116. A further vertical wall 120 is provided for each arm to strengthen it and to secure it to the adaptor 100 the wall 120 being shaped to conform to the adaptor 100. The arms are coupled to each other by a hydraulic damper 130 (see FIGS. 7 and 8). The end of the arm 112 spans the damper and is provided with two vertical flanges 124 which straddle the damper 130 and are connected to the piston of the damper by nuts 131 which engage threaded portions of the piston. The arm 114 has a bifurcated end 122 which straddles the damper 130 and is connected to trunnions secured to the cylinder of the damper.

FIGS. 7 and 8 show the damper 130 in greater detail. The damper 130 comprises a cylinder 132 having perforated end plates 134 each of which supports a guide 136 for a piston rod 138 which is integral with a piston 140. Two plates 142, each provided with a trunnion 144, are secured to upper and lower sides of the end plates 134 by screws 146.

Rubber U-seals 148 seal the space between each guide 134 and the piston rod 138. Further U-seals 150 provide a seal between the cylinder 132 and the piston 140. Plastics bearings 152 and 154, e.g. of nylon, ensure that the piston slides freely in the cylinder and guides.

Chambers 156 are formed at either side of the piston 140 between the piston 140, the piston rod 138, the cylinder 132 and the guides 136. A pair of holes 158 pierce the cylinder 132 to either side of the piston 140 and the chambers 156 to either side of the piston 140 are in communication with each other through the holes 158 and a fluid path having a constriction (not shown). The constriction is adjustable so that the damping coefficience of the damper 130 can be varied.

As shown in FIG. 7 the ends 160 of the piston rods 138 are turned to have a smaller diameter than that of the piston rods 138. These ends 160 are formed with a screw thread which engages with the nuts 131 to secure the piston to the arm 112 (FIGS. 5 and 6). The trunnions 144 are engaged with the bifurcated end 122 of the arm 114 so that the cylinder 132 can pivot relatively to the arm 114 about a vertical axis.

The symmetrical construction of the damper 130 ensures that the chambers 156 and the fluid path connecting the chambers forms a constant volume closed space. The volume of the space will be constant regardless of the position of the piston 140 within the cylinder 132.

We claim:

1. A railway truck having a longitudinal axis in its direction of travel and comprising at least two live wheelsets each having a pair of wheels with profiled treads solidly mounted on an axle, the wheel treads being of a high effective conicity whereby steering forces are generated on curved track by the conical thread independently of the wheel flanges; axle supported bearing means on each wheelset; adapter means on each axle supported bearing means, load-bearing means for distributing truck load forces to each bearing means; elastic constraint means interposed between the load-bearing means and the adaptor means on each axle supported bearing means to provide elastic constraints to lateral and yawing movements of each wheelset relatively to the load-bearing means, the elastic constraints on each wheelset being lower than the steering forces generated by the conical head on curved track so that each wheelset is substantially self steering; and means interconnected the wheelsets to transmit yawing and lateral movements of either wheelset in opposite sense to the other wheelset, whereby hunting of each wheelset is counteracted while the self-steering ability of each wheelset is maintained, the interconnecting means including an extension secured to each adapter means a pair of arms on each side of the longitudinal axis of the truck, the arms on the same side of the truck extending generally towards each other with each arm being solidly secured at one end to the free end of an extension on each wheelset on each side of the truck to transmit moments in a plane parallel to the general plane containing the axes of the wheelsets to that wheelset, and means coupling the other ends of the arms on the same side of the truck together to allow lost motion in the longitudinal direction of the truck between these ends while transmitting movement of each of the arms in a direction transverse to the longitudinal axis and in the plane parallel to the general plane containing the axles to the other arm.

2. A truck as claimed in claim 1 in which the coupling means comprises two elements inter-engaged with and slidable relatively to one another.

3. A truck as claimed in claim 2 in which the interengaging elements are a cylinder and a piston reciprocable within the cylinder.

4. A truck as claimed in claim 2 in which the interengaged elements are arcuate, each of the elements being supported by arcuate arms on a circular path centred on a point on the longitudinal axis of the truck midway between the wheelsets, and each arm is solidly secured to an element.

5. A truck as claimed in claim 2, in which the interengaging elements define between one another at least one variable volume chamber and means is provided to restrict the flow of fluid into and out of the chamber so that the interengaging elements form a fluid damper that resists motion between the ends of the arms which are coupled together.

6. A truck as claimed in claim 5, in which the fluid is a gas.

7. A truck as claimed in claim 5, in which the fluid is a hydraulic fluid.

8. A truck as claimed in claim 2, in which one of the interengaging elements is pivotally connected about a vertical axis to one of the arms and the other element is solidly connected to the other arm.

9. A truck as claimed in claim 8, in which the vertical axis for the pivotal connection passes through the transverse axis of the truck midway between and parallel to the wheelsets when they are parallel and square.

10. A truck as claimed in claim 2, in which the coupling elements are arcuate, each arcuate element being supported by arcuate arms on a circular path centred on a point on the longitudinal axis of the truck midway between the wheelsets.

11. A truck as claimed in claim 10, in which the arcuate arms of a pair of arms that are coupled to each other are of unequal length.

* * * * *